US008596836B2

(12) United States Patent
Pedersen et al.

(10) Patent No.: US 8,596,836 B2
(45) Date of Patent: Dec. 3, 2013

(54) MOVING HEAD FIXTURE AND COOLING MODULE

(75) Inventors: Allan Pedersen, Aarhus C (DK); Mazyar Abolfazlian, Aarhus C (DK)

(73) Assignee: Martin Professional A/S, Aarhus N (DK)

( * ) Notice: Subject to any disclaimer, the term of this patent is extended or adjusted under 35 U.S.C. 154(b) by 274 days.

(21) Appl. No.: 13/133,173

(22) PCT Filed: Dec. 15, 2009

(86) PCT No.: PCT/DK2009/050337

§ 371 (c)(1),
(2), (4) Date: Jun. 7, 2011

(87) PCT Pub. No.: WO2010/069327

PCT Pub. Date: Jun. 24, 2010

(65) Prior Publication Data

US 2011/0235330 A1 Sep. 29, 2011

(30) Foreign Application Priority Data

Dec. 19, 2008 (DK) ..... 2008 01819

(51) Int. Cl.
*F21V 29/02* (2006.01)

(52) U.S. Cl.
USPC ..... 362/373; 362/249.02; 362/249.03; 362/294; 362/800

(58) Field of Classification Search
USPC ..... 362/249.02, 249.03, 294, 373, 800
See application file for complete search history.

(56) References Cited

U.S. PATENT DOCUMENTS

| | | | | |
|---|---|---|---|---|
| 6,067,227 | A * | 5/2000 | Katsui et al. | 361/695 |
| 7,144,140 | B2 | 12/2006 | Sun et al. | |
| 7,318,652 | B2 * | 1/2008 | Pohlert et al. | 362/18 |
| 8,013,482 | B2 * | 9/2011 | Kurokawa | 310/54 |

(Continued)

FOREIGN PATENT DOCUMENTS

| | | | |
|---|---|---|---|
| CN | 1563785 | A | 1/2005 |
| CN | 201093265 | Y | 7/2008 |

(Continued)

OTHER PUBLICATIONS

International Search Report for International Application No. PCT/DK2009/050337, dated Mar. 11, 2010.

(Continued)

*Primary Examiner* — Anabel Ton
(74) *Attorney, Agent, or Firm* — Roberts Mlotkowski Safran & Cole, P.C.; David S. Safran

(57) ABSTRACT

The present invention relates to a moving head light fixture, which moving head light fixture comprises a light generating head, which head is carried in a yoke, which head is rotatable to the yoke, which yoke is rotatable to a base, which head comprises at least one electronic circuit for LED control, where the moving head comprises a first cooling plate comprising a number of LEDs; a second cooling plate comprising said at least one electronic circuit for LED control; and an air flow passage running from at least one end of said moving head, through at least said first cooling plate and/or said second cooling plate and between said first cooling plate and said second cooling plate. The present invention relates also to a cooling module for a moving head.

22 Claims, 8 Drawing Sheets

(56) References Cited

U.S. PATENT DOCUMENTS

| | | | | |
|---|---|---|---|---|
| 8,025,417 | B2 * | 9/2011 | Pohlert et al. | 362/9 |
| 2004/0208009 | A1 | 10/2004 | Mardon et al. | |
| 2005/0128752 | A1 | 6/2005 | Ewington et al. | |
| 2005/0169015 | A1 | 8/2005 | Luk et al. | |
| 2008/0247874 | A1 * | 10/2008 | Acre et al. | 416/95 |
| 2010/0204841 | A1 | 8/2010 | Chemel et al. | |

FOREIGN PATENT DOCUMENTS

| | | | |
|---|---|---|---|
| CN | 201246718 | Y | 5/2009 |
| DE | 200 07 235 | U1 | 7/2000 |
| EP | 2 025 999 | A2 | 2/2009 |
| WO | 2008/108832 | A1 | 9/2008 |
| WO | 2009/033051 | A1 | 3/2009 |

OTHER PUBLICATIONS

Danish Search Report for Danish Application No. PA 2008 01819, dated Jun. 3, 2009.

Supplementary European Search Report for Application No. EP 09 83 2958 DATD Jul. 30, 2013.

* cited by examiner

MOVING HEAD FIXTURE AND COOLING MODULE

FIELD OF THE INVENTION

The present invention relates to a moving head light fixture, which moving head light fixture comprises a light generating head, which head is carried in a yoke, which head is rotatable to the yoke, which yoke is rotatable to a base, which head comprises electronic circuits for LED control.

The present invention further relates to a cooling module for a moving head light fixture.

BACKGROUND OF THE INVENTION

Light fixtures currently tend to use light sources with a high lumen, and the light sources are thus provided with high power. The light sources are getting more and more efficient and uses more and more of the supplied energy to generate light; however a considerable part of the power is still generated into heat. For example, arrayed LEDs (light-emitting diode) in a light fixture may have such high power as 500 watts. In this case, it is desired to have a light device with a heat-dissipating system, which works fast and efficiently.

The pending patent US 2005219841 disclosed an illuminating device and projection type video display where three primary colors light sources are provided as a light source. Each light source is a light source in which pluralities of LEDs (light-emitting diodes) are arranged in the same plane surface. The three light sources are arranged on the same plane surface. Furthermore, lines connecting the three light sources form a triangle. Light fluxes (primary optical axes) of each light source are parallel with each other. The three light sources are arranged on one piece of a cooling plate. Further, a wind generator is arranged in such a manner as to be surrounded by said three solid light sources, and air taken in by said wind generator is blown to said cooling plate. Generally, a fan is used in a light device in order to dissipate the heat generated by the light device. However, for the three light sources are arranged on the same plane, the disadvantage of the above illuminating device and projection type video display is the size of the light device is large and the light sources of the device are not movable, thus, the cooling system above-described could not applied in the light fixture with moving head. The space in a moving head is further very limited compared to the Illuminating device and projection type video display of US2005219841, and the electronic circuits for LED control thus are positioned very close to the LEDs, and a further demand on cooling is needed, since the LED control circuits also generate heat.

EP202599 discloses a power LED lighting assembly includes power LEDs (each 1 watt, for example) mounted on a small circuit board of aluminum. To promote air ventilation, the LED circuit board is provided with air openings to communicate with the heat sink. A heat sink enclosure for accommodating the heat sink is also provided with air openings to communicate with the surrounding atmosphere. A micro fan is fixed above the heat sink for forced air ventilation. A temperature sensor is also installed to sense abnormal temperature increases in the assembly to adjust or reduce the intensity of light and protect LEDs against abnormally high temperature. The micro fan is turned on for heat release automatically on a temperature increase. The driver board is housed in a driver box which is separate from the heat sink enclosure. It is in many applications such as in connection with projectors and moving heads impossible to position the driver board in a drive box which is separated from the LED housing.

DESCRIPTION OF THE INVENTION

The object of the present invention is to solve the above described problems. This can be achieved by a moving head light fixture, which moving head light fixture comprises a light generating head, which head is carried in a yoke, which head is rotatable to the yoke, which yoke is rotatable to a base, which head comprises at least one electronic circuit for LED control, further said moving head comprises a first cooling plate comprising a number of LEDs; a second cooling plate comprising said at least one electronic circuit for LED control; and an air flow passage running from one at least one end of said moving head, through at least said first cooling plate or said second cooling plate and between said first cooling plate and said second cooling plate.

Hereby it is possible to create a compact moving head light fixture where both the LEDs and electronic drive circuits are effectively cooled. This is achieved by positioning the LEDs on the first cooling plate and the electronic circuit for LED control on the second cooling plate. The air flow passage makes it possible to lead air between the cooling plates, as the air passage runs through at least one of the cooling plates and forms a tunnel between the first and second cooling plates, which is helpful for the air flow and whereby both the LEDs and electric circuits are cooled using the same air. The size of the light fixture could be more compressed, as both the LEDs and the electric circuits could be cooled using the same air. Moreover, the LEDs are placed on the first cooling plate and the electronic circuit for LED driving is arranged on the second cooling plate, thus the configuration is capable of directly conducting the heat produced by the LEDs and the driver respectively to an outer shell of the moving head. Further it is possible to cool the LEDs and electronic circuits for LED control from the inside and out, as the air passage runs through one on the cooling plates. This is advantageously, as the LEDs and the electronic circuits for LED control positioned at the centre of the cooling plates tend to be the hottest and by cooling from the inside and out makes sure that the hottest parts are cooled first. The position where the air passage goes through the cooling plates can thus be positioned at the near the hottest places.

In one embodiment of the present invention, the moving head comprises a wind generator directing air through at least a part of said air flow passage. Hereby the wind generator can increase the speed of the air flow and the heat then can be dissipated more quickly.

As an embodied solution, the wind generator is a centrifugal fan positioned between the first cooling plate and the second cooling plate. Hereby it achieves a quieter and more effective cooling effect. The centrifugal fan sucks air through one of the cooling plates from one end of the moving head and "throws" thereafter the air between the cooling plates by the blade tips. The air makes in other words a 90-degree-angle turn as it travels from the inlet to the outlet and is "thrown" from the blade tips. Generally, centrifugal fan is quieter than the axial fans. As the heat produced by the LEDs and electronic circuits for LED control are mainly concentrated near the center of the first and second cooling plate, where the fan is arranged, it is possible that the hottest part of the light fixture is cooled firstly.

The first cooling plate and the second cooling plate are in another embodiment connected by at least one spacer. Hereby is achieved that the heat generated by the LEDs and the electric circuits for LED control would be removed more effective, as another heat dissipate way is created. When the spacer is made of a heat conducting material, such as aluminum, copper, any other kind of metal or alloy, then it is possible to form thermal conduction from the cooling plates to the spacer. Thus, except for the air flow by the fans, another way for heat conducting is created, and a more compact moving head light could be constructed. Moreover, the spacer is located between the first and second cooling plate, where a common used room containing the wirings from both the LEDs and the electrical circuit for LED could be provided. Therefore, quite advantageously, both the LEDs and electronic drive circuits are effectively cooled and the size of moving head light fixture is more compacted.

In another embodiment of the present invention, the spacer provides at least one cavity between the first cooling plate and the second cooling plate. Hereby it is possible to protect the electronics from dust and moist, as the cavity provides a room for the wirings between the LEDs and the electrical circuit for LED control. When a plurality of cavities is formed on the spacer, the wirings are capable of being arranged more orderly in the limited space. The advantage is a more reducing space is formed. Another advantage is, the moving head generally comprises an outer shell for containing the LEDs and the electrical circuits, when the outer shell of the moving head has blowholes, the cavity is capable of preventing the dust and moist from contacting the wirings.

In another embodiment of the present invention, the spacer is helix shaped and forms a plurality of air paths between said first cooling plate and said second cooling plate. Hereby it is possible to provide more effective cooling effect. When the space is helix shaped, it provides a plurality of paths for directing air flowing through helixes. The helix shaped spacers could e.g. be formed such that air from a centrifugal fan positioned between the cooling plates would be directed tangentially into the plurality of paths. The advantage is the hot air is easier to flowing from center to outsider, whereby a more efficient cooling is achieved.

In another embodiment of the present invention, the moving head comprises a first outer shell and a second outer shell with a plurality of fins; said fins are comb shape formed along said first and second outer shell, which fins are overlapped each other when the first and second outer shell joined. Hereby an effective heat-dissipating outer shell is created. Blowholes will be formed on the outer shell, when the fins do not overlap each other entirely. The heat therefore could be blow from the inside of the moving head to the outside through these blowholes. Further, it could save more material for outer shell.

The moving head light fixture comprises in another embodiment of the present invention at least one shell with a plurality of fins arranged parallel to each other and vertical protruding outward from the shell. Hereby it is possible to improve heat dissipating. A plurality fins formed on the outer shell is able to conduct more heat in the effectively way.

In another embodiment of the present invention, at least a part of said spacers, said first cooling plate and/or said second cooling plate are connected to at least a part of said shell. Hereby it is possible to improve the heat dissipating of the moving head even further. The material of the spacer, the first cooling plate and/or the second cooling plate could be made of a heat conducting material, for example, aluminum, cooper or steel, any other kind of metal or alloy. When a part of said spacers, said first cooling plate and/or said second cooling plate are connected to at least a part of said shell, because of contact directly it is possible that thermal conduction is formed. Thermal conduction is the more effective manner than the heat transfer heat by convection and radiation. Therefore, the cooling effect is enhanced.

The invention further relates to a cooling module for a moving head light fixture, which moving head light fixture comprises a light generating head, which head is carried in a yoke, which head is rotatable to the yoke, which yoke is rotatable to a base, which head comprises at least one electronic circuit for LED control, said cooling module comprises a first cooling plate comprising a number of LEDs; a second cooling plate comprising said at least one electronic circuit for LED control; and an air flow passage running from at least one end of said moving head, through at least said first cooling plate or said second cooling plate and between said first cooling plate and said second cooling plate.

Hereby a compact cooling module for a moving head could be constructed and the same technical effects and advantages as described above are achieved. Further by the cooling module improves the serviceability of the moving head as it could be constructed as one module which easily could be remove from and replaced in the moving head. For instance in connection with service and/or cleaning.

Further embodiments of the cooling module are described below and the same technical effects and advantages as described above are achieved by these embodiments.

In another embodiment, said cooling module comprises a wind generator directing air through at least a part of said air flow passage.

Further in one another embodiment said wind generator is a centrifugal fan positioned between said first cooling plate and said second cooling plate.

Yet in another embodiment, the first cooling plate and the second cooling plate is connected by at least one spacer.

In another embodiment, the spacer provides at least a cavity between said first cooling plate and said second cooling plate.

As an alternate embodiment above, the spacer of the cooling module is helix shaped and forms a plurality of air paths between said first cooling plate and said second cooling plate.

DETAILED DESCRIPTION OF THE INVENTION

Figure 1:
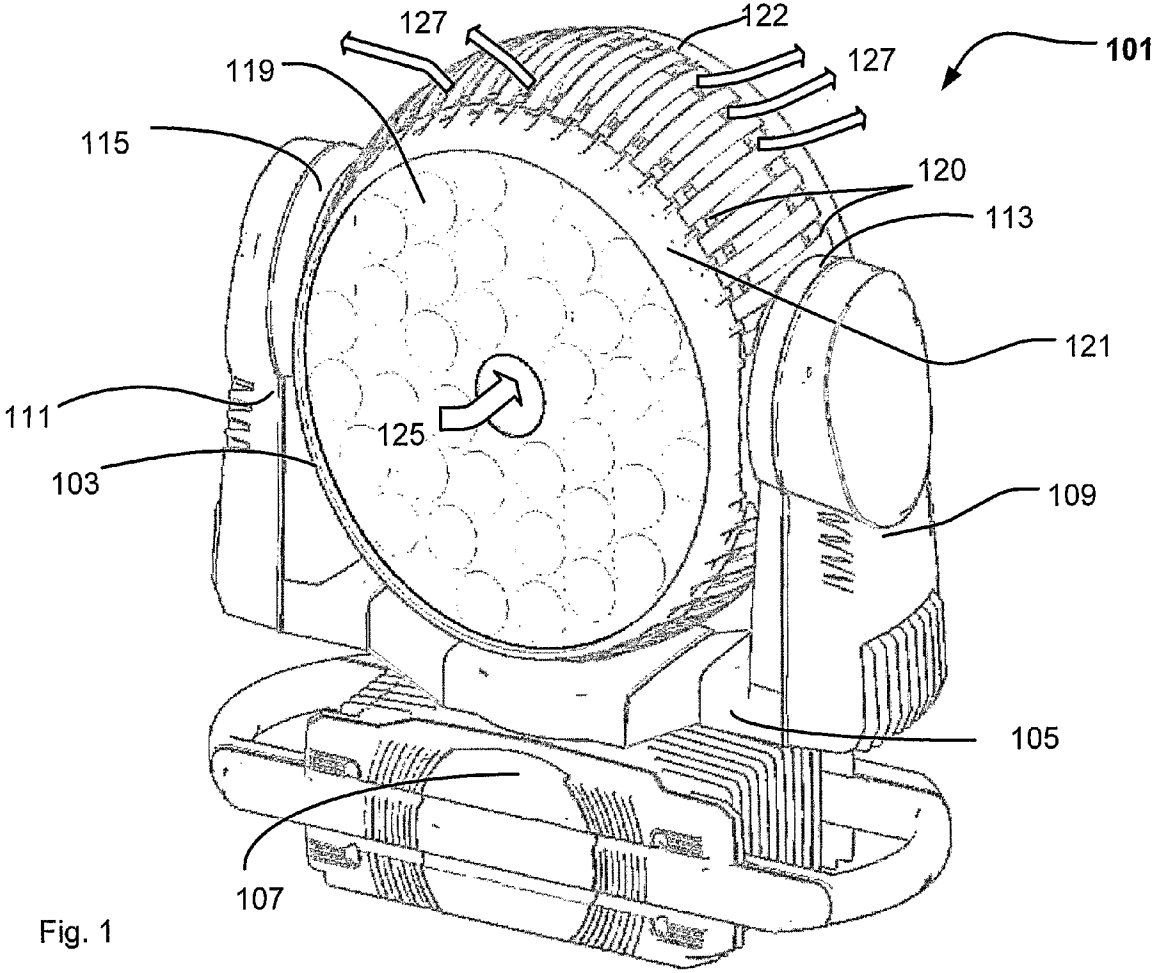
FIG. 1 illustrates a perspective view of a moving head light fixture of the present invention.

FIG. 1 shows a first possible embodiment for the invention. A moving head light fixture 101 comprises a head 103 which head is rotatably supported in a yoke 105. The yoke 105 is rotatably supported by a base 107. The yoke 105 comprises a first arm 109 and a second arm 111, where which first arm 109 ends in a bearing 113 and which second arm 111 ends in a bearing 115. The bearings 113 and 115 are carrying the head 103. The moving head 103 in the illustrated embodiment is barrel shaped and comprises an end section 119 seen from the front. Moving head 103 is covered by an outer shell 121 with cooling fins 122. There are also a number of blowholes 120 on the surface of the outer shell 121 which will help the heat be led from the inside to the outside.

FIG. 1 also shows the air flow direction through the light fixture, and it can be seen that air is led as illustrated by arrow 125 into the fixture at one end 119 of the light fixture and led out of as illustrated by arrows 127 through blowholes 120 of the light fixture.

Figure 2:
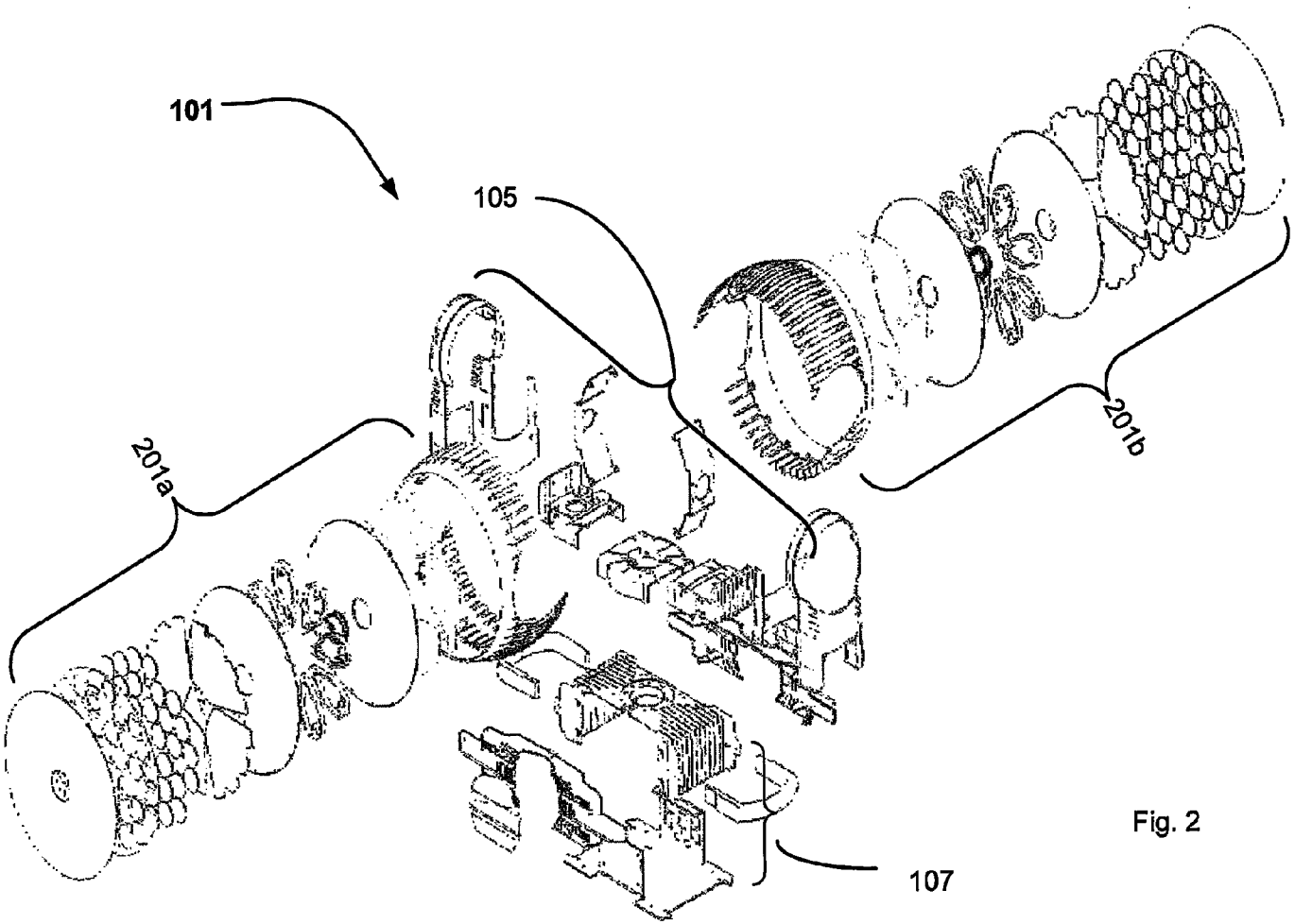
FIG. 2 illustrates an exploded perspective view of a double-sided moving head light fixture of an embodiment of the present invention.

FIG. 2 illustrates an exploded perspective view of the first possible embodiment of the moving head light fixture according to the invention with double-sided light emitting ends. The light fixture comprises a base 107, a yoke 105 and the moving head comprises two light generating parts 201*a*, 201*b* capable of emitting light. The details of the light generating parts are described in FIGS. 3 and 4.

Figure 3:
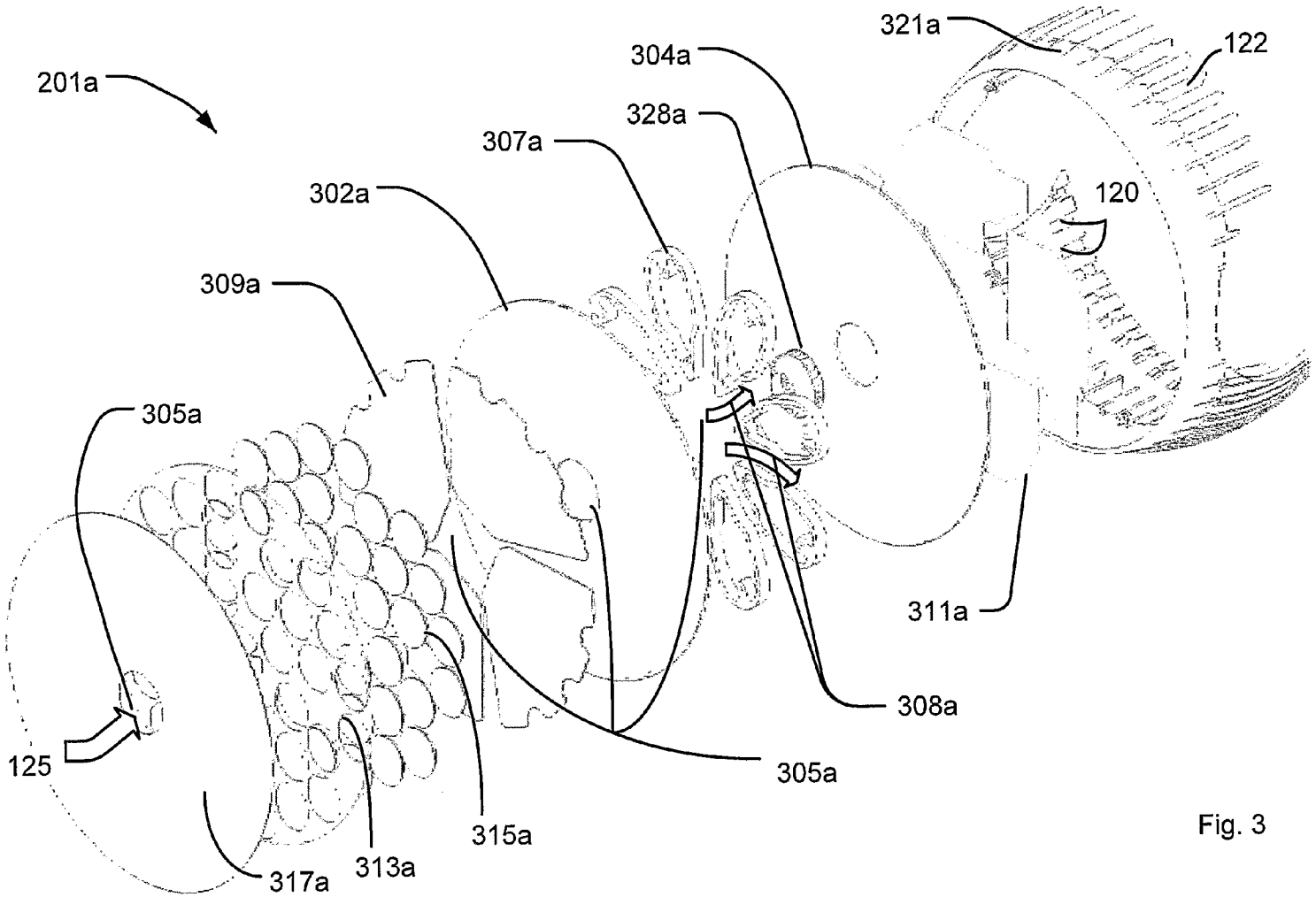
FIG. 3 illustrates an exploded perspective view of one half of the double-side moving head light fixture illustrated in FIG. 2.

FIG. 3 illustrates an exploded perspective view of a half 201*a* of the above double-side moving head light fixture 101 of the first embodiment of the present invention. The other half 201*b* of the moving head 103 has the identical components as illustrated in FIG. 3. For the symmetrical structure, only the light generating parts 201*a* in FIG. 2 are illustrated in FIG. 3 and described below. The first light generating parts 201*a* comprises a first cooling plate 302*a*, comprising a number of PCB 309*a* (print circuits boards) with LEDs are placed; a second cooling plate 304*a* comprising a number of electronic circuits 311*a* for LED control; and an air flow passage 305*a* running through said first cooling plate 302*a* and expanding along the axes of the moving head 103 to the front cover 317*a*. The front cover 317*a* is in the shown embodiment transparent and the light from the LED would thus pass through the front cover. The front cover could also be formed as a color filter and/or any kind of optical lens.

The illustrated moving head comprises four electronic circuits 309*a* with LEDs, which are displayed above the first cooling plate 302*a* and four electrical circuits for LED control which are arranged beneath the second cooling plate 304*a*. The skilled person would realize that any number of electronic circuits could be used.

A lens array 315*a* is positioned corresponding to the LEDs and deflects the light emitted by the LED. A holder 313*a* with a number of holes which are capable of supporting the lens array 315*a* is further arranged above the LEDs. A number of spacers 307*a* are located between the first and second cooling plate 302*a* and 304*a* and wind generator 328*a* is positioned between said first cooling plate 302*a* and said second cooling plate 304*a*. The wind generator is in one embodiment a centrifugal fan that sucks air into the moving heat from the front as illustrated by the arrow 125 and "throws" the air between the first 302*a* and second 304*a* cooling plate, where the air passes as illustrated by the arrows 308*a* around the spacers.

As shown in FIG. 2 and FIG. 3, light generating parts 201*a* and 201*b* are covered by a first outer shell 321*a* and a second outer shell (not shown in the FIG. 3). A plurality of fins 122 are comb shaped formed along both the first and second shells respectively, and the fins from both shells interlocked each other when the first outer shell 321*a* and second outer shell are joined. When the fins 122 are not overlapped each other entirely, some blowholes 120 are formed on the first outer shell 321*a* and second outer shell. Therefore, the heat dissipating effect is enhanced by the fan 328*a* as air would leave the moving head through the blowholes 120. Further cooling could be applied, if the diameters of the first cooling plate 302*a*, the second cooling plate 304*a* and the spacer 307*a* are large enough to reach the outer shells 321*a* directly, whereby heat could be conducted from the inside of the moving head to the outside of the moving head.

Figure 4:
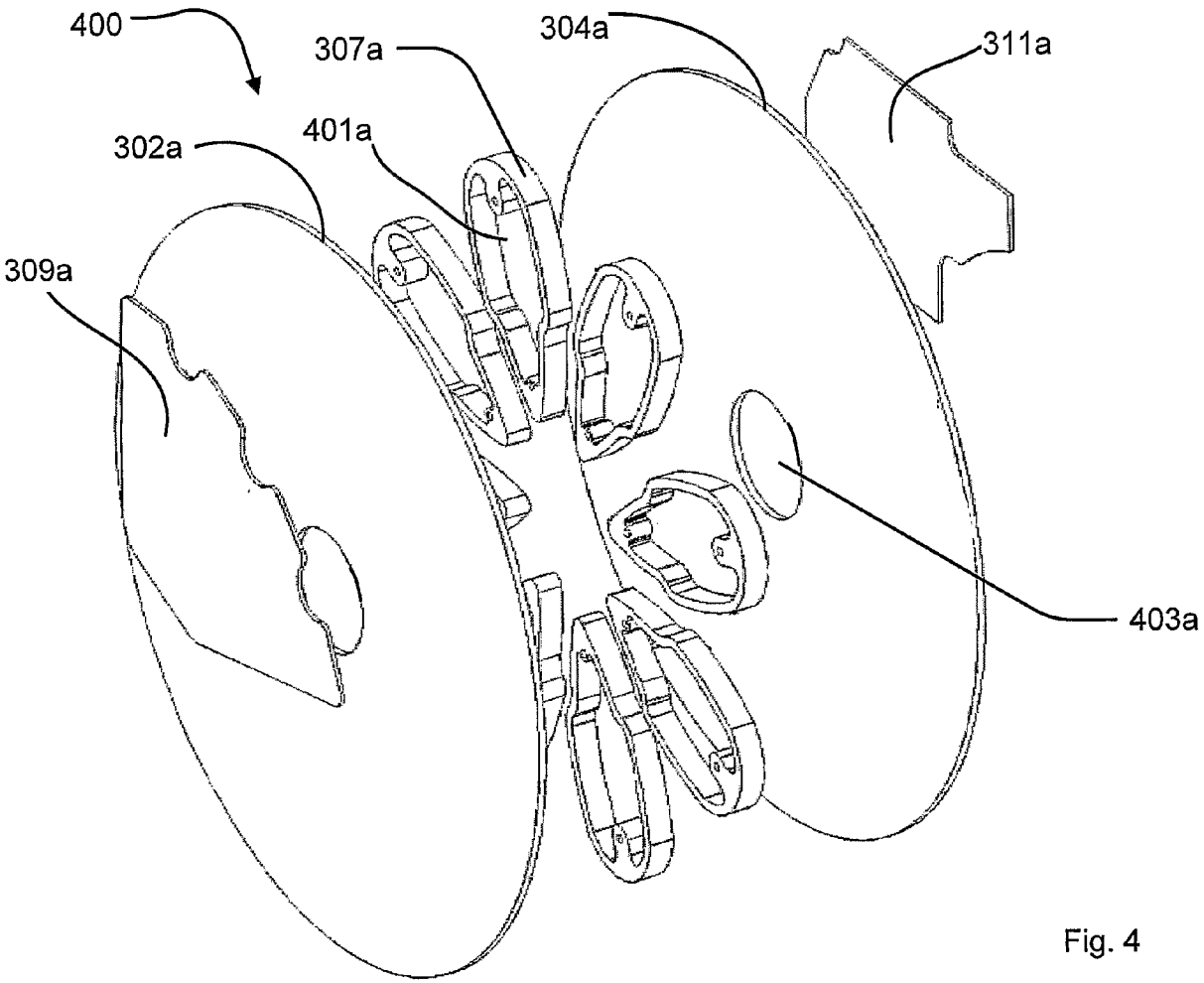
FIG. 4 illustrates an enlarged exploded perspective view of one half of the double-side moving head light fixture illustrated in FIGS. 2 and 3.

FIG. 4 illustrates an enlarged exploded perspective view of the cooling module 400 of the moving head of the present invention. The first cooling plate 302*a* and said second cooling plate 304*a* are connected by a number of spacers 307*a*. Spacer 307*a* is ear shaped and forms a cavity 401*a*. The wires from LED PCB 309*a* and control PCB 311*a* could be arranged more orderly in the cavities respectively whereby dust and moist are prevented from polluting the electrical connections.

A centrifugal fan (not shown in FIG. 4) could be positioned between the first 302*a* and the second 304*a* cooling plates as illustrated in FIG. 3. The centrifugal fan would suck air through the first cooling plate 302*a* and throw the air out between the two cooling plates similar to the embodiment illustrated in FIG. 3. The second cooling plate 304*a* comprises in this embodiment also an air passage 403*a* and it is thus possible to suck air from both sides of the cooling plates or lead some of the air through the second cooling plate.

Figure 5:
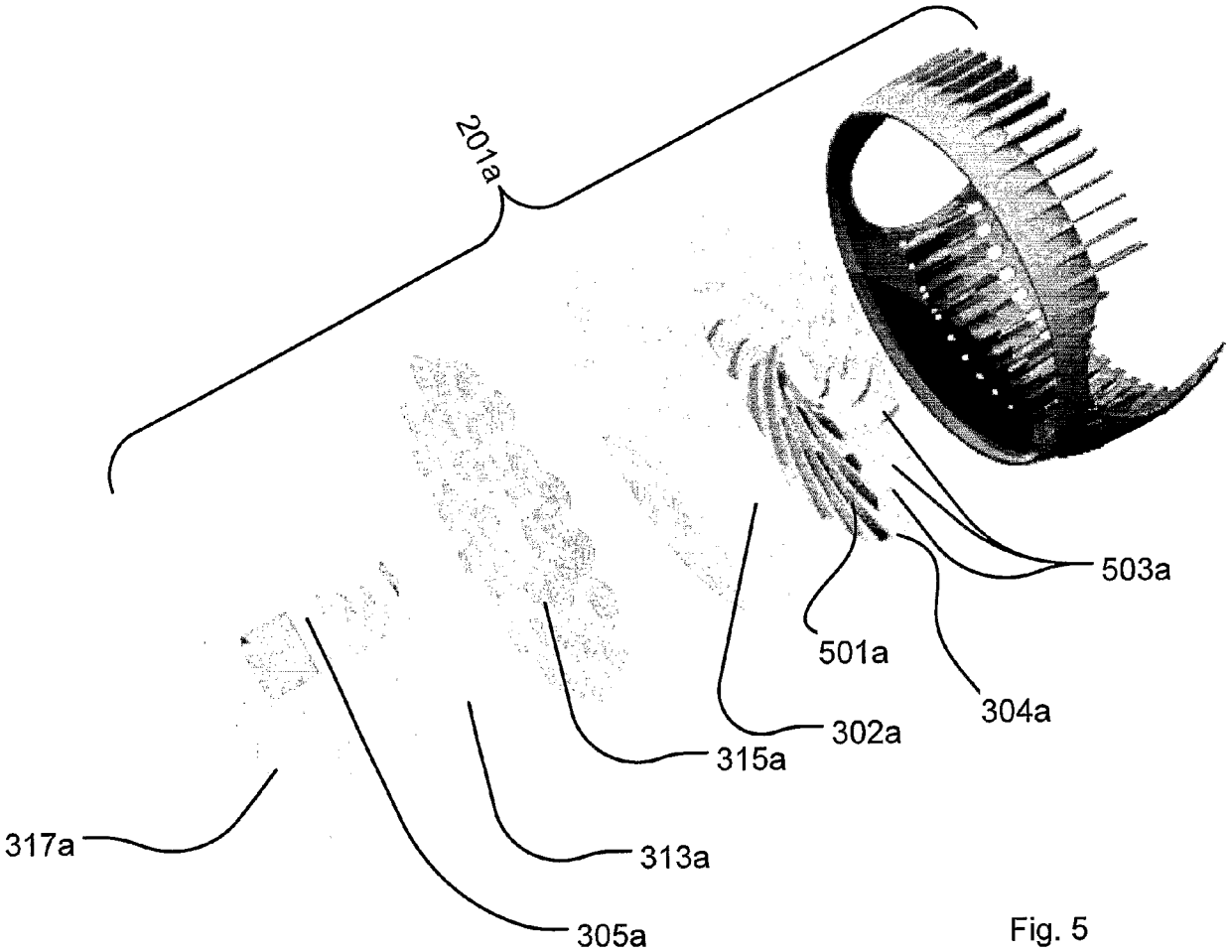
FIG. 5 illustrates an enlarged exploded perspective view of one half of another embodiment of a double-side moving head light fixture.

FIG. 5 illustrates an exploded perspective view of one half of another embodiment of a moving head light fixture according to the present invention. This embodiment comprises a first cooling plate 302*a* comprising a number of PCB (not shown)); a second cooling plate 304*a* comprising a number of electronic circuits (not shown) for LED control; an lens array 315*a* and a lens holder 313*a* and air flow passage 305*a* running through said first cooling plate 302*a* and expanding along the axes of the moving head to the front cover 317*a*.

A number of spacers 501*a* are positioned under the first cooling plate 302*a* and form a group of helix shaped fins, where a pluralities of paths 503*a* are formed, which are capable of increasing the air flow efficiency.

Figure 6:
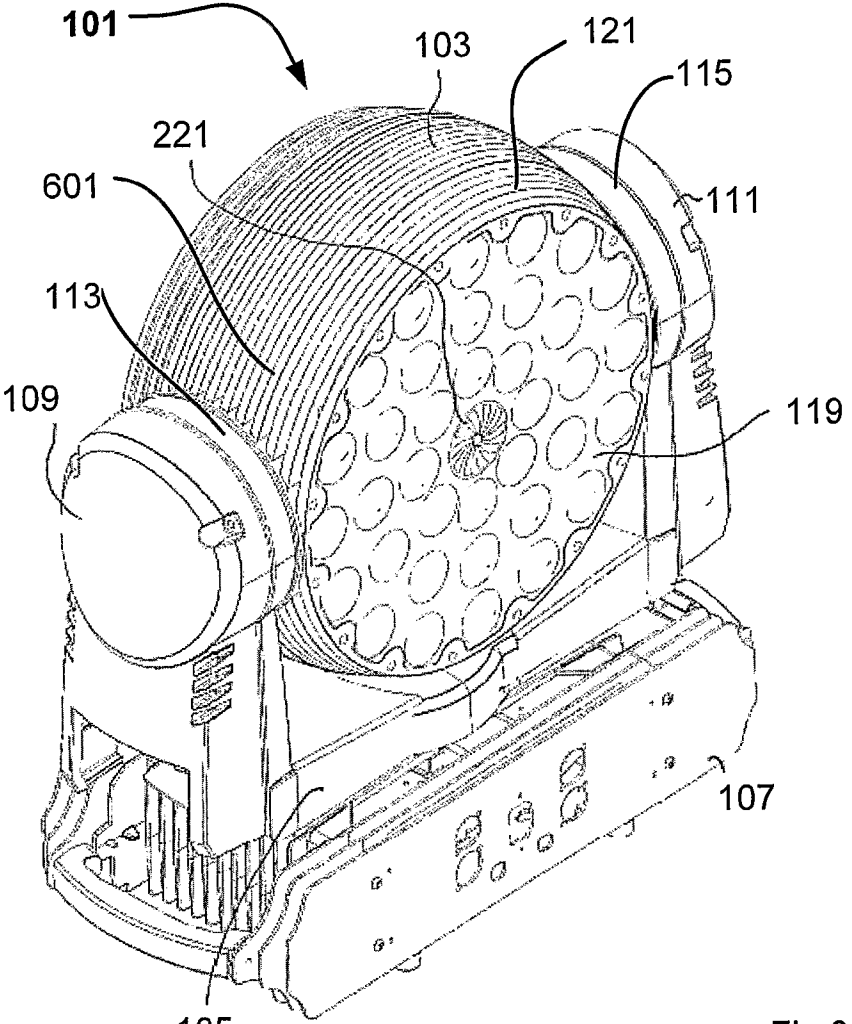
FIG. 6 illustrates a perspective view of another embodiment of a moving head light fixture with fins protruding from the outer shell of the present invention.

FIG. 6 illustrates a perspective view of another embodiment of a moving head light fixture with fins protruding outward from the outer shell of the present invention. A moving head light fixture 101 comprises a head 103 which head is rotatably supported in a yoke 105. Said yoke 105 is rotatably supported by a base 107. The yoke 105 comprises a first arm 109, a second arm 111 which first arm 109 ends in a bearing 113 which second arm 111 ends in a bearing 115. The bearings 113 and 115 are carrying the head 103. The moving head 103 in the illustrated embodiment is barrel shaped and comprises an end section 119 seen from the front. The lenses 20, 22 and 24 are forming three concentric circles at the FIG. 6. In the centre of the front end section 119 is indicated a fan 221. Moving head 103 is covered by outer shell 121. Outside of the moving head 103 is formed a plurality of cooling fins 601. Said fins 601 are arranged parallel each other and protruding outward from the outer shell 121. These fins 601 are forming a very powerful heat sink. There will be extremely good airflow between the fins and in that way effective cooling is achieved.

The spacer 307*a* and the cooling plate 302*a*, 304*a* of all the embodiments could be constructed as one component. Or the spacer and cooling plates could be constructed as two separate objects where the spacer is attached to the cooling plates by attaching means, such as glue, screws, magnetic force, welding etc.

Figure 7:
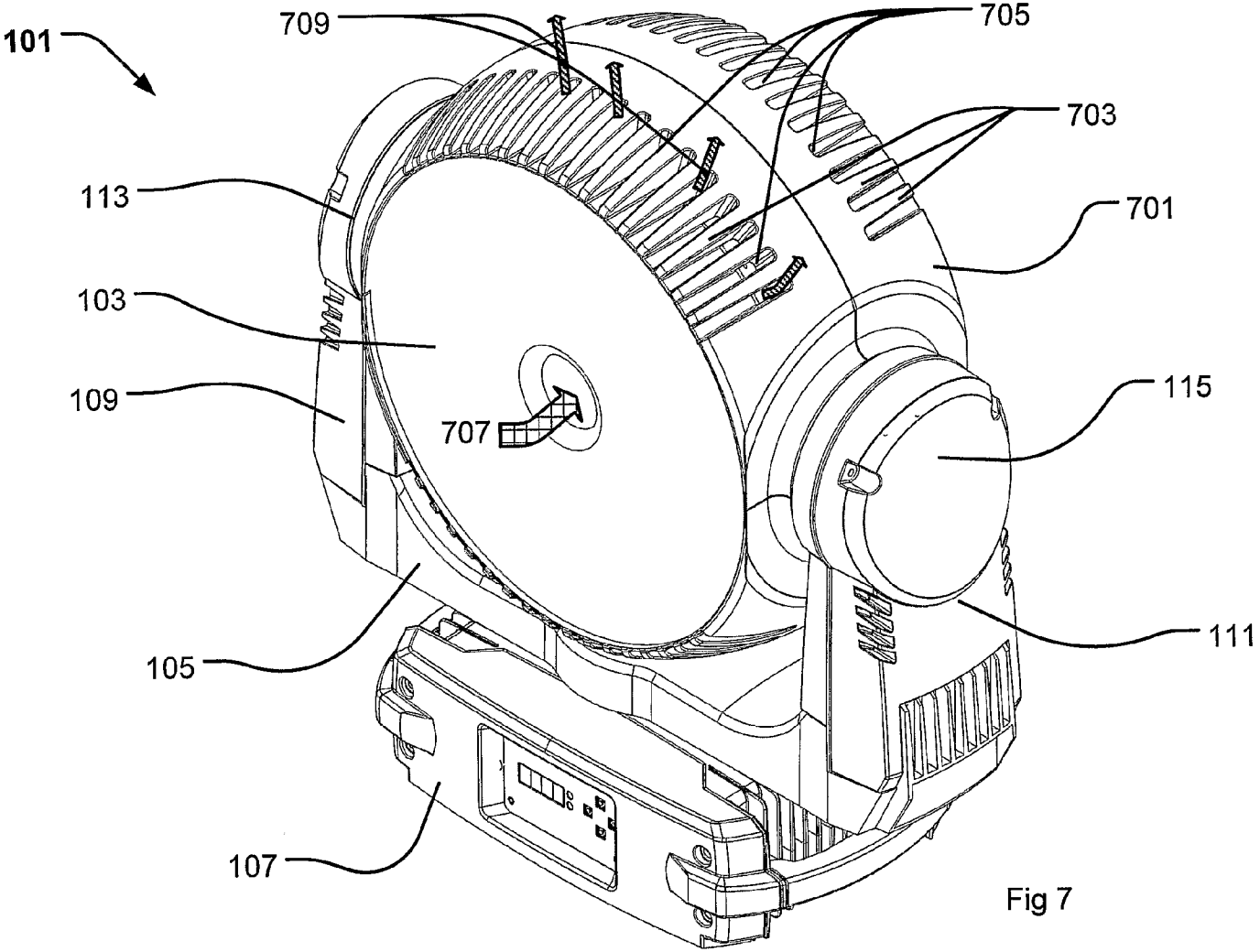
FIG. 7 illustrates a perspective view of yet another embodiment of a moving head light fixture according to the present invention.

FIG. 7 shows a yet another embodiment for the invention. A moving head light fixture 101 comprises a head 103 which head is rotatable supported in a yoke 105. The yoke 105 is rotatable supported by a base 107. The yoke 105 comprises a first arm 109 and a second arm 111, where which first arm 109 ends in a bearing 113 and which second arm 111 ends in a bearing 115. The bearings 113 and 115 are carrying the head 103. Moving head 103 is covered by an outer shell 701 with cooling fins 703. There are also a number of blowholes 705 on the surface of the outer shell 701 which will help the heat to be led from the inside to the outside.

FIG. 7 also shows the air flow direction through the light fixture, and it can be seen that air is led as illustrated by arrow 707 into the fixture at one end of the light fixture 101 and led out of as illustrated by arrows 709 through blowholes 705 of the light fixture.

Figure 8:
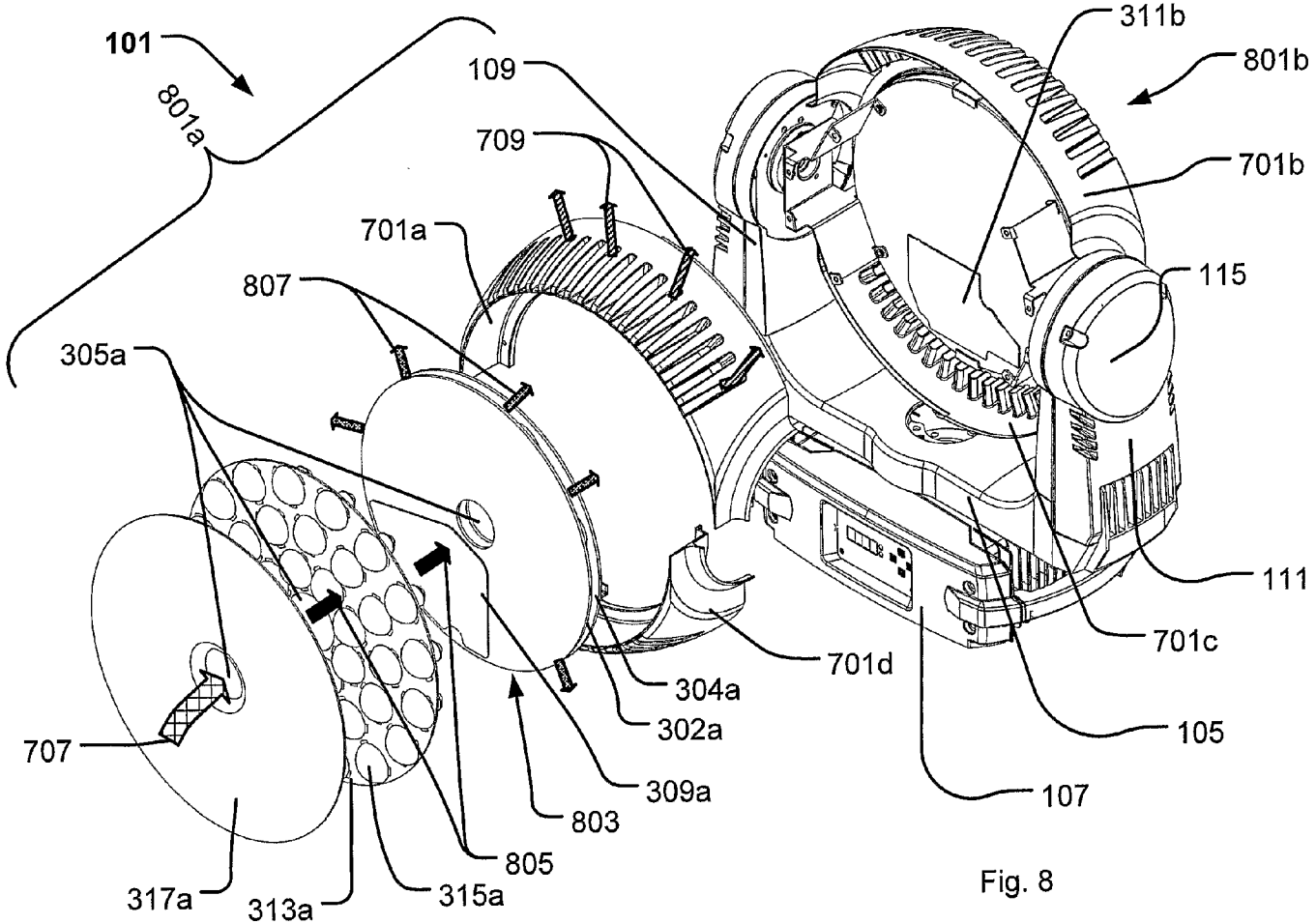
FIG. 8 illustrates a perspective view of the moving head light fixture of FIG. 7 where one half of the moving head has been exploded.

FIG. 8 illustrates a perspective view of the moving head light fixture of FIG. 7 where one half 801*a* of the moving head has been exploded and where the other half 801*b* is identical to the first half. The skilled person would however realize that the two halves do not need to be identical and they can be constructed different in order to create different light og effects the sides of the moving head.

The first half 801*a* comprises a cooling module 803 according to the present invention. The cooling module 803 comprises a first cooling plate 302*a*, comprising a number of PCBs 309*a* (print circuits boards) where LEDs are placed; a second cooling plate 304*a* comprising a number of electronic circuits (not shown, but the corresponding electronic circuit 311*b* on the second half can be seen) for LED control. The drawing illustrates only one PCB board 309*a* with LEDs (not shown) and only one electronic circuits for led control 311*b*, but the skilled person would realize that any number of these components could be used. The moving head comprises further an air flow passage 305*a* running from the front cover 317*a* at one end of the moving head through a lens array 315*a*, through the first cooling plate 302*a* and between the first and second cooling plates. Air would be let in to the air passage 305*a* at the front cover 317*a* as illustrated by arrow 707 and flow through the air passage 305*a* as illustrated by arrows 805. The air would then be let out between the cooling plates as illustrated by arrows 807 and thereafter out of the moving head through the blow holes of the outer shell as illustrated by arrows 709. The illustrated embodiment comprises a centrifugal fan (not shown) which sucks the air as illustrated by arrows 805 through the air passage 305*a* and directs the air out as illustrated by arrows 807 between the first and second cooling plate.

The front cover 317*a* is transparent in the shown embodiment and the light from the LED would thus pass through the front cover. The front cover could also be formed as a color filter and/or any kind of optical lens.

A lens array 315*a* is positioned corresponding to the LEDs and deflects the light emitted by the LED. A holder 313*a* with a number of holes which are capable of supporting the lens array 315*a* is further arranged above the LEDs. The cooling module 803 is similar to the once described above. The moving head comprises an outer shell comprising four parts 701*a* 701*b* 701*c* and 701*d*. Each part comprises a plurality of fins and blow holes.

Although the present invention was discussed in terms of certain preferred embodiments, the invention is not limited to such embodiments. A person of ordinary skill in the art will appreciate that numerous variations and combinations of the features set forth above can be utilized without departing from the present invention as set forth in the claims. Thus, the scope of the invention should not be limited by the preceding description but should be ascertained by reference to claims that follow.

The invention claimed is:

1. Moving head light fixture, which moving head light fixture comprises a light generating head, which head is carried in a yoke, which head is rotatable to the yoke, which yoke is rotatable to a base, which head comprises at least one electronic circuit for LED control wherein said moving head comprises:

a first cooling plate comprising a number of LEDs;

a second cooling plate comprising said at least one electronic circuit for LED control; and an air flow passage running from at least one end of said moving head, through at least one of said first cooling plate and said second cooling plate and between said first cooling plate and said second cooling plate.

2. A moving head according to claim 1, wherein said moving head comprises a wind generator directing air through at least a part of said air flow passage.

3. A moving head according to claim 2, wherein said wind generator is a centrifugal fan positioned between said first cooling plate and said second cooling plate.

4. A moving head according to claim 1, wherein said first cooling plate and said second cooling plate being connected by at least one spacer.

5. A moving head according to claim 4, wherein said spacer provides at least one cavity between said first cooling plate and said second cooling plate.

6. A moving head according to claim 4, wherein said spacer is helix shaped and forms a plurality of air paths between said first cooling plate and said second cooling plate.

7. A moving head according to claim 4, wherein said moving head light fixture comprises at least one shell with a plurality of fins-protruding outward from the shell.

8. A moving head according to claim 7, wherein at least a part of said spacers, said first cooling plate and/or said second cooling plate are connected to at least a part of said shell.

9. A cooling module for a light fixture, said light fixture comprises electronic circuits for LED control wherein said cooling module comprises:

a first cooling plate comprising a number of LEDs;

a second cooling plate comprising said at least one electronic circuit for LED control; and an air flow passage running through at least one of said first cooling plate and said second cooling plate and between said first cooling plate and said second cooling plate.

10. A cooling module according to claim 9, wherein said cooling module comprises a wind generator directing air through at least a part of said air flow passage.

11. A cooling module according to claim 10, wherein said wind generator is a centrifugal fan positioned between said first cooling plate and said second cooling plate.

12. A cooling module according to claim 11, wherein said first cooling plate and said second cooling plate being connected by at least one spacer.

13. A cooling module according to claim 12, wherein said spacer provides at least one cavity between said first cooling plate and said second cooling plate.

14. A cooling module according to claim 13, wherein said spacer is helix shaped and forms a plurality of air paths between said first cooling plate and said second cooling plate.

15. A cooling module according to claim 12, wherein at least a part of said spacers, said first cooling plate and/or said second cooling plate are connected to at least a part of a shell surrounding at least a part of said cooling module.

16. A moving head according to claim 6, wherein said moving head comprises a wind generator directing air through at least one of said plurality of air paths.

17. A moving head according to claim 1, wherein said moving head light fixture comprises at least one shell with a plurality of fins protruding outward from the shell.

18. A moving head according to the claim 17, wherein at least a said first cooling plate and/or said second cooling plate are connected to at least a part of said shell.

19. A moving head according to claim 14, wherein said cooling module comprises a wind generator directing air through at least one of said plurality of air paths.

20. A cooling module according to claim 15, wherein said shell comprises a number of fins protruding outward from said shell.

21. A cooling module according to claim 9, wherein at least said first cooling plate and/or said second cooling plate are connected to at least a part of a shell surrounding at least a part of said cooling module.

22. A cooling module according to claim 21, wherein said shell comprises a number of fins protruding outward from said shell.

* * * * *